US005547353A

United States Patent [19]

Yamaguchi et al.

[11] Patent Number: 5,547,353

[45] Date of Patent: Aug. 20, 1996

[54] SCROLL TYPE COMPRESSOR WITH ELLIPTICAL SPIRAL ELEMENT

[75] Inventors: Tetsuya Yamaguchi; Yasushi Watanabe; Tetsuhiko Fukanuma, all of Kariya; Yasuhiro Oki, Okazaki; Yuuji Yamamoto, Toyota, all of Japan

[73] Assignees: Kabushiki Kaisha Toyoda Jidoshokki Seisakusho; Nippondenso Co., Ltd., both of Kariya, Japan

[21] Appl. No.: 510,600

[22] Filed: Aug. 3, 1995

[30] Foreign Application Priority Data

Aug. 5, 1994 [JP] Japan ..... 6-184979

[51] Int. Cl.[6] ..... F01C 1/04

[52] U.S. Cl. ..... 418/55.2

[58] Field of Search ..... 418/55.2, 150

[56] References Cited

U.S. PATENT DOCUMENTS 4,655,696 4/1987 Utter .
4,886,433 12/1989 Maier ..... 418/55.2
5,141,417 8/1992 Bush .
5,281,114 1/1994 Bush .
5,419,690 5/1995 Goto et al. ..... 418/55.2

FOREIGN PATENT DOCUMENTS 113195 5/1988 Japan ..... 418/55.2
67213178 9/1993 Japan .
5-248366 8/1994 Japan .

*Primary Examiner*—Charles Freay
*Attorney, Agent, or Firm*—Brooks Haidt Haffner & Delanunty

[57] ABSTRACT

A scroll type compressor includes a front housing, a fixed scroll, a movable scroll and a rear housing, and its lateral cross section has a substantially oval shape. The spiral element of the movable scroll is located in the space defined by the front housing and the fixed scroll in such a way as to engage with the spiral element of the fixed scroll. The space defined by the fixed scroll and the rear housing serves as a discharge chamber where compressed refrigerant gas is discharged. Since this compressor has the same compression displacement as that of a compressor having a circular cross section, this compressor can be placed in narrow space whose width is less than the width of the circular compressor, without any reduction in the cooling performance.

8 Claims, 7 Drawing Sheets

SCROLL TYPE COMPRESSOR WITH ELLIPTICAL SPIRAL ELEMENT

BACKGROUND OF THE INVENTION

1. Field of the Invention

The present invention relates generally to a compressor for compressing a fluid such as air or refrigerant gas, and, more particularly, to a scroll type compressor.

2. Description of the Related Art

Conventional air conditioning systems for vehicles are equipped with compressors, which compress refrigerant gas to permit vaporized refrigerant (refrigerant gas) to be easily liquefied by a condenser. Conventional compressors include piston type compressors, which compress fluid by the reciprocating action of pistons, and vane type compressors, which compress fluid by the rotation of a rotor provided with a vane. Recently, scroll type compressors, which accomplish internal compression with higher efficiency than piston type or vane type compressors, have been put to practical use.

With reference to FIG. 7, the basic structure of a scroll type compressor for use in an ordinary air conditioning system for a vehicle will be described. FIG. 7 is a cross-sectional view of a prior art scroll type compressor as viewed from the front, and shows only a fixed scroll and a movable scroll for simplicity.

The ordinary scroll type compressor comprises a fixed scroll 71, which is secured to an outer wall 77 or the like, and which serves as a non-rotating, and a movable scroll 73, which is coupled to an eccentric shaft (not shown) to rotate. The spiral element 72, of the fixed scroll 71 engages with the spiral element 74 of the movable scroll 73, defining compression chambers 75 between both scrolls 71 and 73. When the eccentric shaft is rotated by a power source like an engine (not shown), the movable scroll 73 makes an orbital movement about the axis of the fixed scroll 71. The compression chambers 75 gradually move toward the center portion from the peripheral side of the spiral element 74, thus accomplishing the gas compression. The outer wall 77 has the shape of a complete round, and the spiral elements 72 and 74 of both scrolls 71 and 73 are formed along involute curves having complete rounds of predetermined radii as reference circles.

However, installing the conventional scroll type compressor into an automobile raises the following problem. Due to the recent progression of electronic controls for vehicles, multiple control components such as actuators and sensors for various controls are installed in the engine compartment of a vehicle. When a compressor for an air conditioning system is mounted on a vehicle, there may be no extra space in the vertical direction of the compressor while there may be some extra space in the widthwise direction of the compressor, or vice versa. It is difficult to secure sufficient space in the engine compartment.

One may think that this shortcoming can be overcome by simply making the compressor compact. However, if the individual scrolls 71 and 73 are made smaller, the compression displacement is reduced, and the cooling performance is lowered.

SUMMARY OF THE INVENTION

Accordingly, it is a primary objective of the present invention to provide a scroll type compressor which can be installed in small space without reducing the compression displacement.

To achieve the foregoing and other objects and in accordance with the purpose of the present invention, a scroll type compressor is provided. The scroll type compressor includes compression chambers which are defined between a fixed spiral element of a fixed scroll and a movable spiral element of a movable scroll by engaging with each other, wherein said compression chambers suck a fluid in accordance with an orbital movement of the movable scroll around the fixed scroll to compress and discharge the fluid. The compressor comprises a substantially elliptical housing for accommodating the movable scroll and the fixed scroll. The fixed scroll has a substantially elliptical end plate. The movable spiral element is formed on the end plate. The movable scroll has a substantially elliptical end plate, and the end plate has the movable spiral element formed thereon.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
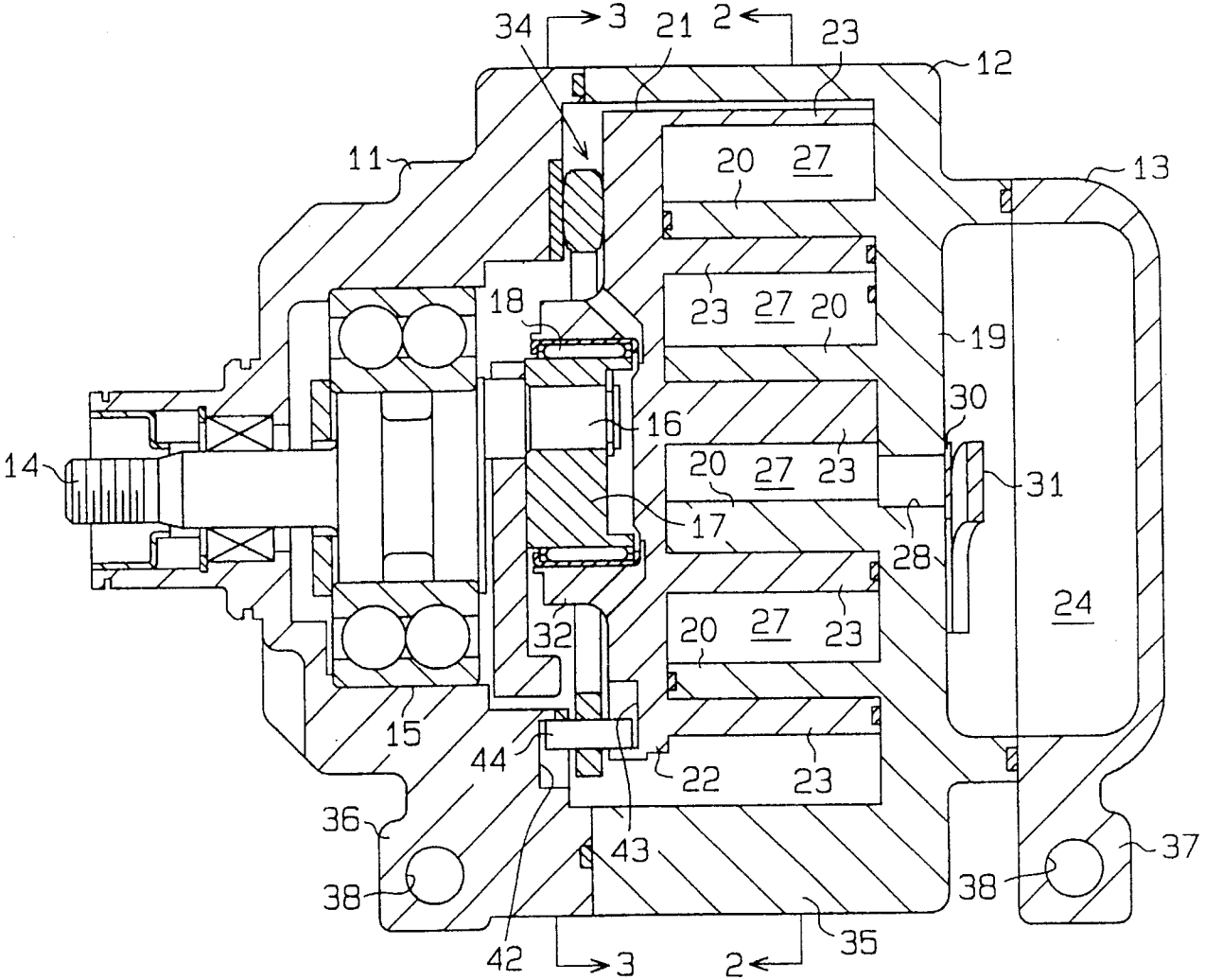
FIG. 1 is a cross-sectional side elevation view of a scroll type compressor according to one embodiment of this invention.
Figure 2:
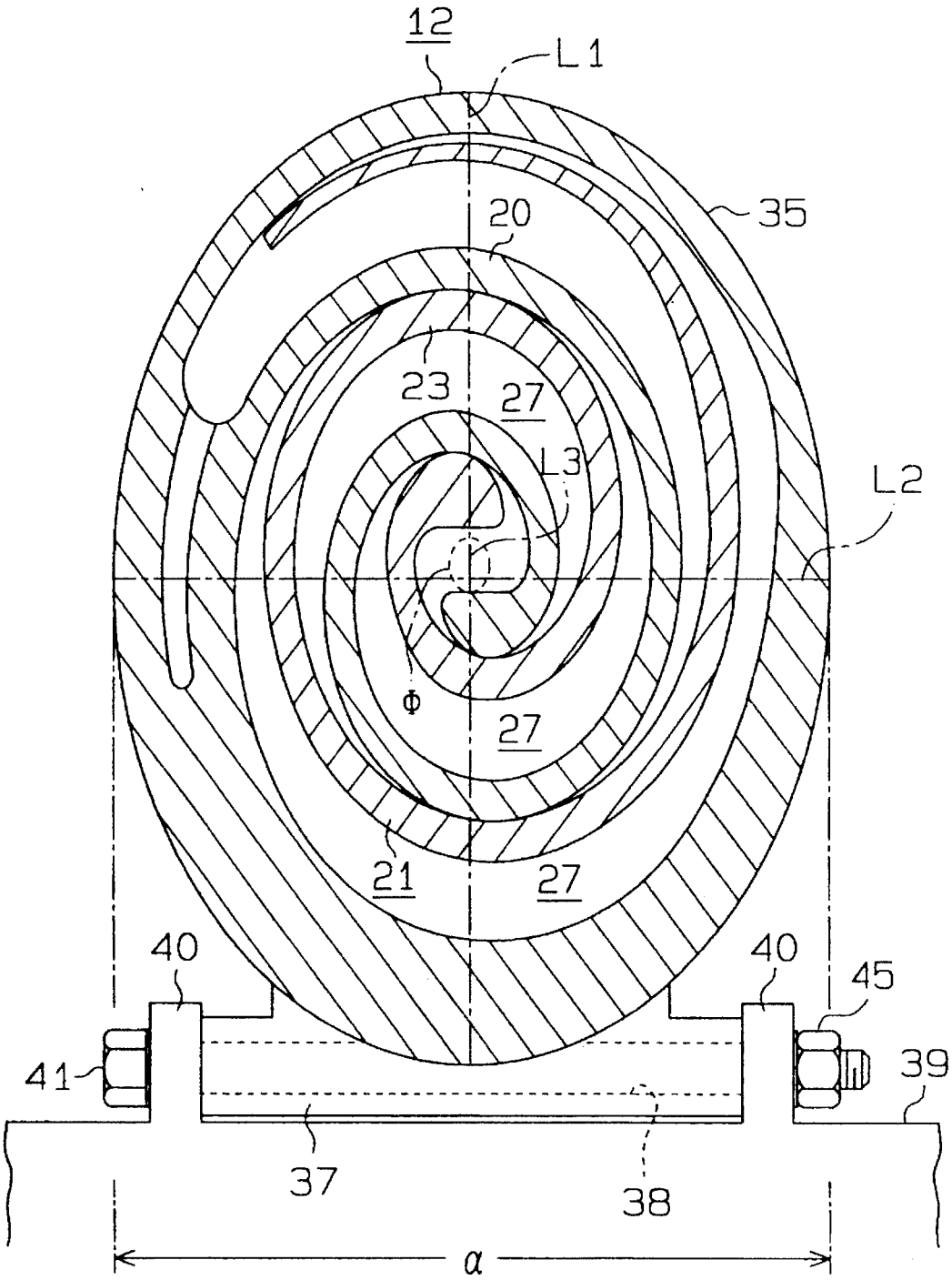
FIG. 2 is an cross-section view illustrating a fixed scroll and a movable scroll taking along the line 2—2 in FIG. 1.

One embodiment of the present invention will be now described with reference to FIGS. 1 and 2. The scroll type compressor comprises a front housing 11, a fixed scroll 12, a movable scroll 21 and a rear housing 13. Its lateral cross section has a substantially oval shape as shown in FIG. 2. The front housing 11 is coupled to the front end of a spiral element 20 of the fixed scroll 12 by a bolt (not shown). The movable scroll 21 is disposed in the space defined by the front housing 11 and the fixed scroll 12 in such a way as to engage with the fixed scroll 12. The rear housing 13 is coupled to the rear end of the spiral element 20 of the fixed scroll 12 by a bolt (not shown). The space defined by the fixed scroll 12 and the rear housing 13 serves as a discharge chamber 24 where compressed refrigerant gas is discharged.

Figure 3:
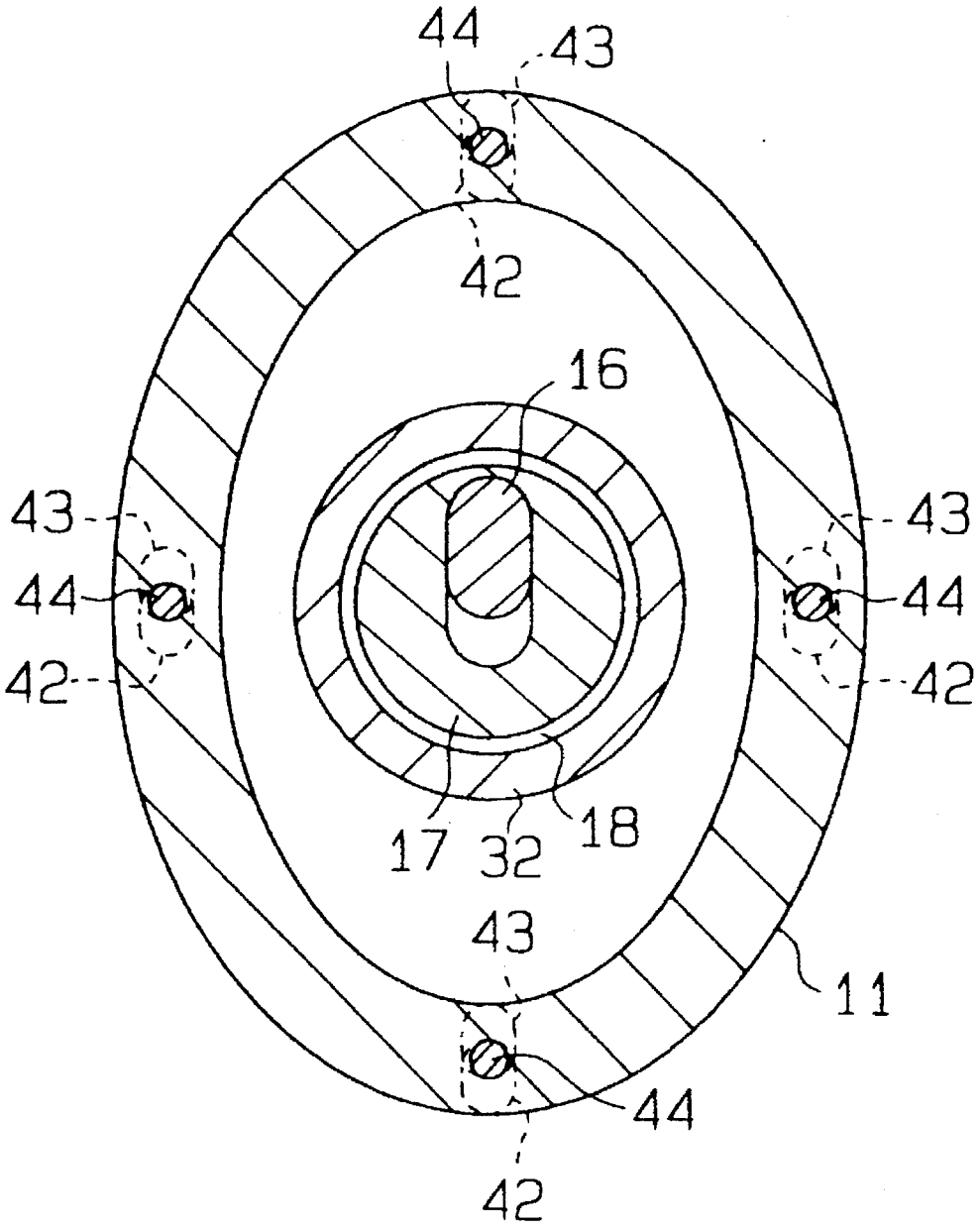
FIG. 3 is a cross-sectional view taken along the line 3—3 in FIG. 1.

A shaft 14 is supported via a main bearing 15 on the front housing 11. An eccentric shaft 16, which is eccentric to the axis of the shaft 14, protrudes from the internal end of the shaft 14. This eccentric shaft 16 has an oval cross sectional as shown in FIG. 3. A bush 17, which is slidable along the direction of the major axis of the oval of the eccentric shaft 16, is attached to the eccentric shaft 16. A plurality of grooves 42, which have oval cross sections and constitute a part of a rotation preventing mechanism 34, are formed on the inner wall of the front housing 11 as shown in FIG. 3. This rotation preventing mechanism 34 inhibits the movable scroll 21 from rotating about its rotational axis, and permits the orbital movement of the movable scroll 21 about the axis of the shaft 14. Attachment legs 36 for attachment to a vehicle are formed integrally with the front housing 11 at the periphery of the bottom of the front housing 11. Each attachment leg 36 has a bolt hole 38.

The fixed scroll 12 has an end plate 19, which is formed in an oval shape having a major axis L1 and a minor axis L2; an outer wall 35, which extends frontward toward the front housing 11 from the peripheral edge of the end plate 19 and is coupled directly to the front housing 11; and the spiral element 20 formed in a spiral shape at the front face of the end plate 19. The overall lateral cross section of the fixed scroll 12 has an oval shape as shown in FIG. 2. A discharge port 28 is formed in the center of the end plate 19 to discharge compressed refrigerant gas into the discharge chamber 24, and a discharge valve 30 for opening or closing the discharge port 28 is disposed on the end plate 19 in the discharge chamber 24. A stopper 31 is disposed over the discharge valve 30 to restrict the opening position of the discharge valve 30. As shown in FIG. 2, the spiral element 20 is formed along an involute curve which is drawn based on a reference oval $\phi$ whose major axis L3 lies on the same line as the major axis L1 of the oval end plate 19. An inlet port (not shown) for the introduction of refrigerant gas into the compressor is formed in the outer wall.

The movable scroll 21 has an end plate 22, which is formed in an oval shape, a spiral element 23 formed in a spiral shape at the rear face of the end plate 22, a boss 32 formed at the front face of the end plate 22, and grooves 43, which have oval cross sections and constitute a part of the rotation preventing mechanism 34. The spiral element 23 forms the envelope that matches with the shape of the spiral element 20 of the fixed scroll 12. The grooves 43 of the rotation preventing mechanism 34 are so formed as to face the grooves 42 of the front housing 11, and pins 44 are engaged with both grooves 42 and 43.

The boss 32 is formed on the movable scroll 21, with the bush 17 fitted via a bearing 18 in the boss 32 in a relatively rotatable fashion. As the shaft 14 rotates, therefore, the movable scroll 21 makes an orbital movement via the eccentric shaft 16, bush 17 and bearing 18.

The spiral element 20 of the fixed scroll 12 engages with the spiral element 23 of the movable scroll 21 in such a way that the end portions of the spiral elements 20 and 23 are in contact with or in the vicinity of the end plates 22 and 19 of the opposing scroll. The spaces between the spiral elements 20 and 23 of the scrolls 12 and 21 serve as compression chambers 27 for compressing refrigerant gas. The positions of the compression chambers 27 move toward the center from the periphery in accordance with the orbital movement of the movable scroll 21. The scroll type compressor according to this embodiment is obtained by stretching a conventional compressor having a circular cross section (FIG. 7) in one direction while maintaining the same cross-sectional area. Therefore, the total volume of the compression chambers 27 of the compressor according to this embodiment is the same as the total volume of the compression chambers 75 of the conventional compressor.

The rear housing 13 is formed in an oval shape corresponding to the shape of the fixed scroll 12. Attachment legs 37 for attachment to a vehicle are formed integrally with the rear housing 13 at the periphery of the bottom of the rear housing 13. Each attachment leg 37 has a bolt hole 38. An outlet port (not shown) is formed in the rear housing 13 to discharge the refrigerant gas, expelled from the discharge port 28, outside the compressor.

When this scroll type compressor is mounted on a vehicle 39, bolts 41 are inserted into the bolt holes 38 of the individual attachment legs 36 and 37 and into brackets 40 of the vehicle 39 and are then securely fastened with nuts 45 as shown in FIG. 2.

The action of the thus constituted compressor according to this embodiment will be described along the flow of the refrigerant gas.

When the shaft 14 is rotated by the driving force transmitted from an unillustrated drive source (engine), the eccentric shaft 16 turns so that the movable scroll 21 starts making an orbital movement about the center axis of the shaft 14. At this time, the movable scroll 21 draws an elliptic locus for the following reason. The bush 17 is slidable with respect to the eccentric shaft 16 to allow for a change in the radius of the locus, and the grooves 42 and 43, which constitute a part of the rotation preventing mechanism 34, have oval cross sections.

When the movable scroll 21 starts making an orbital movement, refrigerant gas is introduced into the compressor via the inlet port (not shown) and reaches the outermost portion of the fixed scroll 12. The refrigerant gas which has entered the compressor is gradually supplied into the compression chambers 27. In accordance with the orbital movement of the movable scroll 21, the compression chambers 27 shift toward the centers of the spiral elements 20 and 23 from the peripheral portions thereof while reducing the volumes (while performing gas compression). As the compression chambers 27 shift in this manner, the refrigerant gas in each compression chamber 27 moves toward the centers of the spiral elements 20 and 23 while being gradually compressed. The refrigerant gas which has reached the centers of both spiral elements 20 and 23 forces the discharge valve 30 open from the discharge port 28 to be discharged into the discharge chamber 24. The refrigerant gas is then discharged out of the compressor via the outlet port (not shown) from the discharge chamber 24.

As has been discussed in the foregoing description the scroll type compressor of this embodiment includes the front housing 11, rear housing 13, fixed scroll 12 and movable scroll 21, all formed in oval shapes. The oval shape of this scroll type compressor is obtained by designing a conventional compressor shown in FIG. 7 in an oval shape while keeping the same compression displacement.

Figure 7:
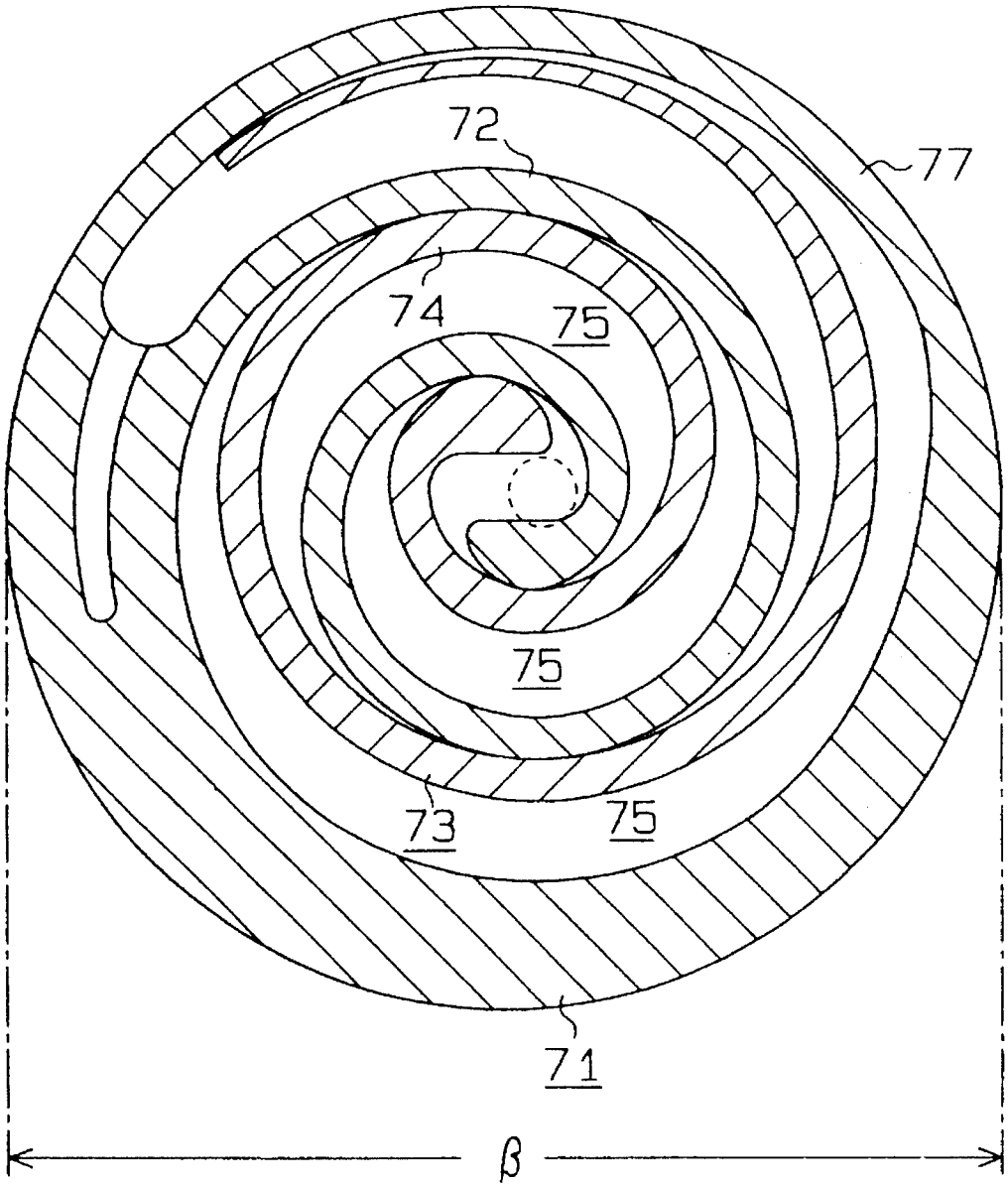
Fig.7 (Prior Art)
FIG. 7 is a cross-sectional view of a scroll type compressor according to prior art.

As shown in FIG. 2, therefore, the width 60 of this compressor can be set smaller than the width 62 of the conventional compressor shown in FIG. 7. Since both compressors have the same compression displacement, the compressor of this embodiment can be placed in narrow space (whose width is less than 62 ) where the conventional compressor of the same displacement cannot be installed.

Figure 4:
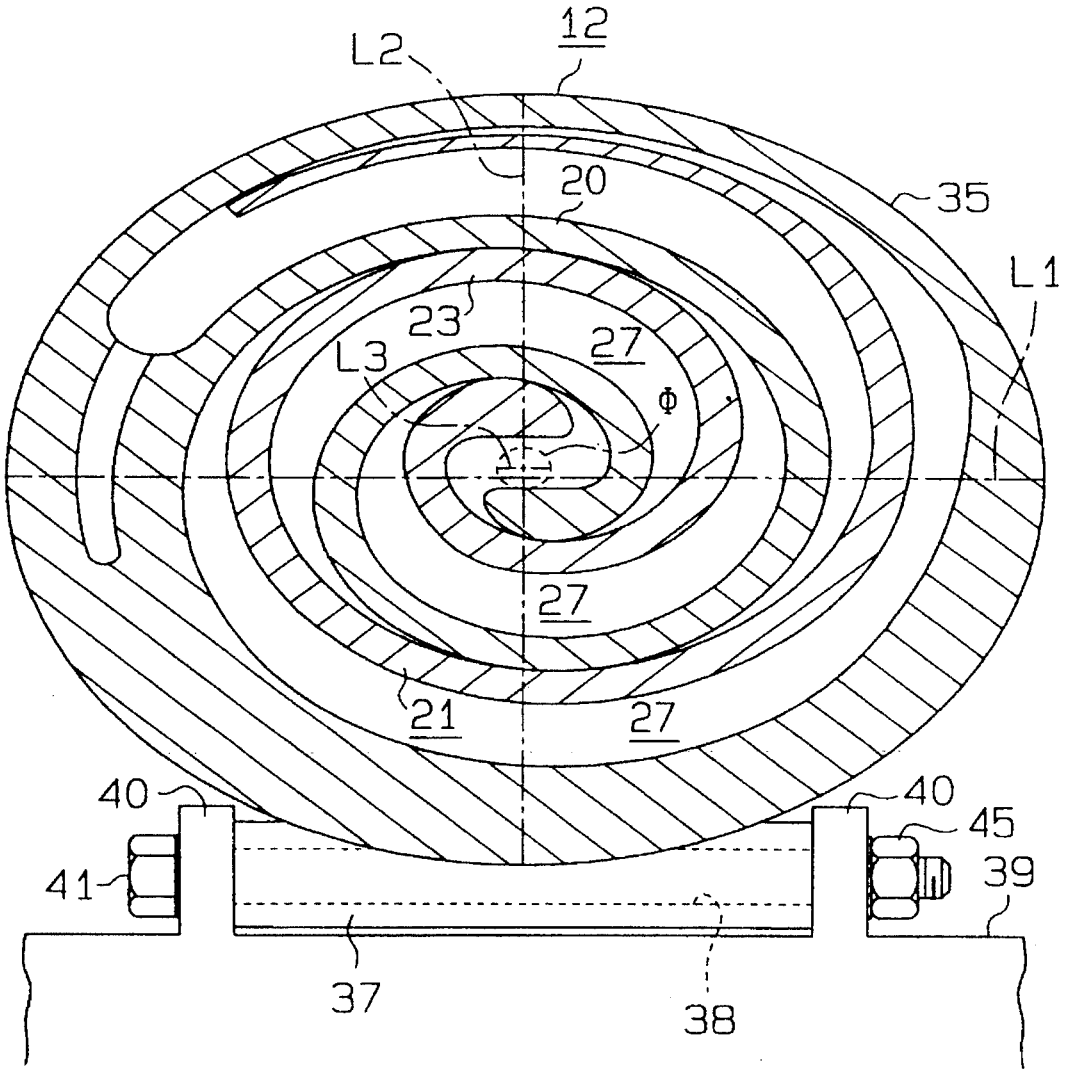
FIG. 4 is a cross-sectional view of a scroll type compressor according to another embodiment of this invention.

Although only one embodiment of the present invention has been described herein, it should be apparent to those skilled in the art that the present invention may be embodied in many other specific forms without departing from the spirit or scope of the invention. Particularly, it should be understood that this invention may be embodied in the following specific forms:

As shown in FIG. 4, the major axis L1 of the end plate 19 of the fixed scroll 12 may be set parallel to the compressor mounting surface of a vehicle so that the compressor has a horizontally elongated oval shape. In this case, the cross sections of the spiral elements 20 and 23 and the front housing 11 should have horizontally elongated oval shapes to match the shape of the end plate 19. This design allows the compressor to be easily installed in a space which has a limited height.

Though not illustrated, the major axis LI of the end plate 19 of the fixed scroll 12 may be inclined with respect to the compressor mounting surface of a vehicle so that the compressor has an obliquely elongated oval shape. In this case, the cross sections of the spiral elements 20 and 23 and the front housing 11 should have obliquely elongated oval shapes to match the shape of the end plate 19. This design allows the compressor to be easily installed in limited space.

Figure 5:
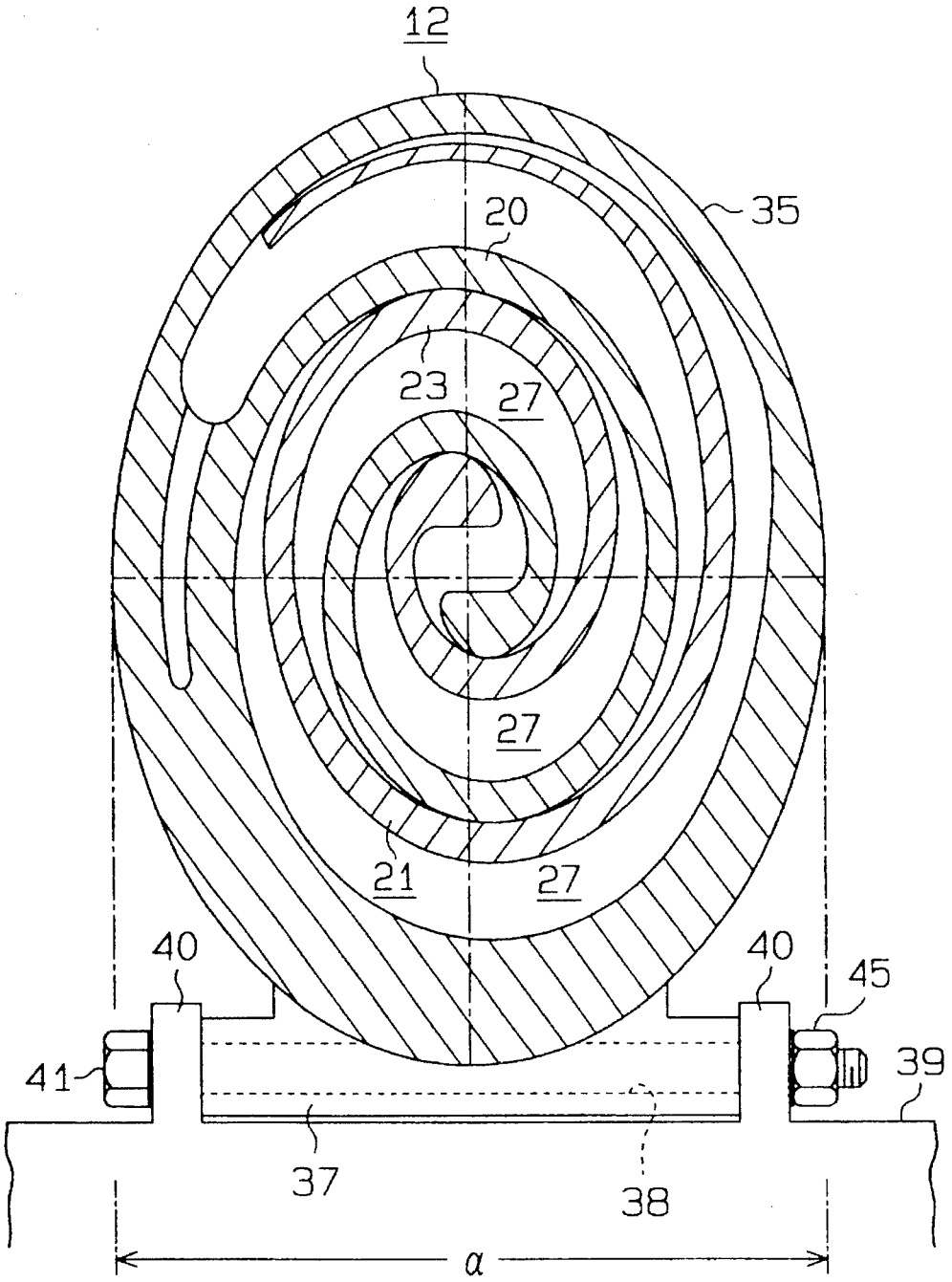
FIG. 5 is a cross-section view of a scroll type compressor which includes a movable spiral element and a fixed spiral element are designed along a single spiral line, which is formed through locating a plurality of ellipses so as to connect adjacent ellipses.
Figure 6:
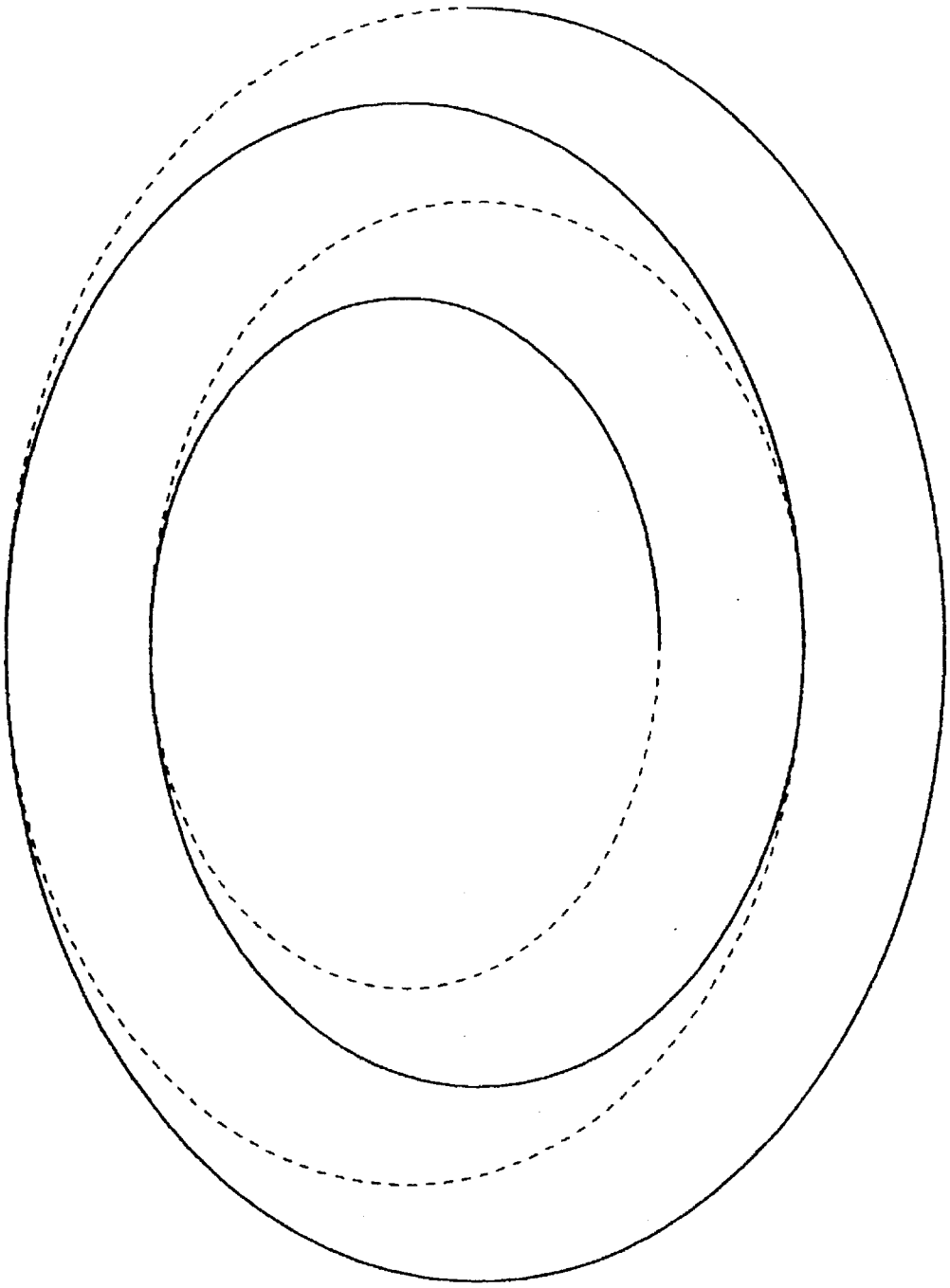
FIG. 6 is a way of connecting adjacent ellipses in a scroll type compressor according to another embodiment of this invention in FIG. 5.

In this embodiment the fixed spiral element 20 and the movable spiral element 23 are formed according to an involute curve alternately, the spiral elements can be formed according to a single spiral line formed by jointing portions a plurality of ellipses as shown in FIG. 5 and FIG. 6. Note that the central ellipse has the smallest major and minor axes, and each successive ellipse has larger dimensions.

Therefore, the present examples and embodiment are to be considered as illustrative and not restrictive and the invention is not to be limited to the details given herein, but may be modified within the scope of the appended claims.

What is claimed is:

1. A scroll type compressor including compression chambers defined between a fixed spiral element of a fixed scroll and a movable spiral element of a movable scroll by engaging with each other, wherein said compression chambers suck a fluid in accordance with an orbital movement of the movable scroll around the fixed scroll to compress and discharge the fluid, said compressor comprising:

a substantially elliptical housing for accommodating the movable scroll and the fixed scroll;

said fixed scroll spiral element having a substantially elliptical spiral shape, and including a substantially elliptical fixed end plate, said fixed end plate having the fixed spiral element formed thereon; and said movable scroll spiral element having a substantially elliptical spiral shape, and including a substantially elliptical movable end plate thereon.

2. A compressor according to claim 1, wherein said housing, said end plate of the fixed scroll and said end plate of the movable scroll have a major axis and a minor axis, and wherein said major axis extends parallel to a plane of a mounting surface on which the compressor is mounted.

3. A compressor according to claim 1, wherein said housing, said end plate of the fixed scroll and said end plate of the movable scroll have a major axis and a minor axis, and wherein said major axis extends perpendicular to a plane of a mounting surface on which the compressor is mounted.

4. A compressor according to claim 2, wherein said fixed spiral element and said movable spiral element are each formed in the shape of an involute curve with an elliptical base curve having a major axis and a minor axis, said major axis of the base curve being substantially aligned with the major axis of the end plate of the fixed scroll.

5. A compressor according to claim 3, wherein said fixed spiral element and said movable spiral element are each formed in the shape of an involute curve with an elliptical base curve having a major axis and a minor axis, said major axis of the base curve being substantially aligned with the major axis of the end plate of the fixed scroll.

6. A compressor according to claim 1, wherein each said movable spiral element and said fixed spiral element is defined by a single spiral line, which is formed by connecting portions of a plurality of ellipses, each having different dimensions.

7. A compressor according to claim 2, wherein each said movable spiral element and said fixed spiral element is defined by a single spiral line, which is formed by connecting portions of a plurality of ellipses, each having different dimensions.

8. A compressor according to claim 3, wherein each said movable spiral element and said fixed spiral element is defined by a single spiral line, which is formed by connecting portions of a plurality of ellipses, each having different dimensions.

* * * * *

UNITED STATES PATENT AND TRADEMARK OFFICE

CERTIFICATE OF CORRECTION

PATENT NO. : 5,547,353

DATED : August 20, 1996

INVENTOR(S) : Yamaguchi et al

It is certified that error appears in the above-indentified patent and that said Letters Patent is hereby corrected as shown below:

Column 4, line 51, after "width" change "60" to --α--;
line 52, after "width" change "62" to --ß--;
line 56, "62" should read --ß--.

Column 5, line 41, delete "formed".

Signed and Sealed this

Twenty-seventh Day of May, 1997

*Attest:*

Bruce Lehman

BRUCE LEHMAN

*Attesting Officer*

*Commissioner of Patents and Trademarks*